US006237387B1

(12) United States Patent
Yoshizawa et al.

(10) Patent No.: US 6,237,387 B1
(45) Date of Patent: May 29, 2001

(54) ENTRANCE ROLLER GUIDE APPARATUS

(75) Inventors: Sadao Yoshizawa, Hokkaido; Toshio Takaoka; Takahiro Miyamoto, both of Osaka, all of (JP)

(73) Assignee: Kotobuki Sangyo Kabushiki Kaisha, Hokkaido (JP)

( * ) Notice: Subject to any disclaimer, the term of this patent is extended or adjusted under 35 U.S.C. 154(b) by 0 days.

(21) Appl. No.: 09/401,359

(22) Filed: Sep. 21, 1999

(30) Foreign Application Priority Data

Apr. 28, 1999 (JP) ..... 11-122895

(51) Int. Cl.[7] ..... B21B 39/20
(52) U.S. Cl. ..... 72/251; 72/250
(58) Field of Search ..... 72/250, 251, 419, 72/420, 428, 426, 225, 227

(56) References Cited

U.S. PATENT DOCUMENTS

| | | | | |
|---|---|---|---|---|
| 3,765,214 | * | 10/1973 | Boehmer | 72/250 |
| 4,039,107 | * | 8/1977 | Boley | 72/250 |
| 4,270,376 | * | 6/1981 | Shimada | 72/231 |
| 4,295,356 | * | 10/1981 | Fabris | 72/250 |
| 4,546,527 | * | 10/1985 | Fukuda et al. | 72/225 |
| 4,680,953 | * | 7/1987 | Fabris | 72/250 |
| 4,790,164 | * | 12/1988 | Rothe | 72/250 |
| 4,860,426 | * | 8/1989 | Engel et al. | 72/229 |
| 5,085,067 | * | 2/1992 | Reismann et al. | 72/225 |
| 5,743,127 | * | 4/1998 | Taskeda et al. | 72/250 |

FOREIGN PATENT DOCUMENTS

| | | | | |
|---|---|---|---|---|
| 152-293 | * | 11/1981 | (DE) | 72/250 |
| 53-32110 | | 8/1978 | (JP) . | |
| 1163-931 | * | 6/1985 | (SU) | 72/250 |

* cited by examiner

*Primary Examiner*—Rodney A. Butler
(74) *Attorney, Agent, or Firm*—Jordan and Hamburg LLP

(57) ABSTRACT

A guide roller apparatus has entry guide and an upper guide provided at an entrance side of an advancing path for a workpiece material to be rolled, and side rollers, upper and lower guide rollers and further tip end chips downward thereof are sequentially provided. The the workpiece is guided into grooves of rolling rollers of a rolling mill without force by the guide roller apparatus. The guide roller apparatus guides the workpiece material having a width larger than that of a caliber of the rolling roll without rolling flaw or torsion occurring in the material to be rolled.

34 Claims, 2 Drawing Sheets

ENTRANCE ROLLER GUIDE APPARATUS

BACKGROUND

The present invention relates to an entrance roller guide apparatus provided for guiding a material to be rolled, hereinafter a workpiece material, to a rolling roller for rolling such a shape steel as a channel steel or the like.

It is well known that related arts greatly influence the quality of a final product when there is torsion or roll flaw of a material to be rolled, or a difference in height between left and right flanges thereof, in a rolling work of a channel steel. Causes of these phenomena include, first, that the width of a workpiece material which has advanced to a rolling roller is larger than that of an opening portion of a roll. Second, another of the causes is due to that it is difficult to identify a deformation of the workpiece material in a grooved rolling so that channel forming becomes difficult, which is well known.

On the contrary, in view of that, when a channel material is rolled, a width of the workpiece material, or the channel material, is conventionally larger than that of the roll opening portion, the width between friction guides is narrowed so that the workpiece material is guided to grooves of rolling rolls while the material passing through between the guides is forcibly shaped.

Also, as a related art, there has been proposed an entrance guide apparatus for a rolling mill where a roughly shaped workpiece material is accurately centered and rolled to be guided to grooves of rolling rolls by a centering roller provided inside the workpiece material having a width larger than a caliber width of the rolling rolls and standing type entrance guide rollers provided outside the workpiece material (Japanese Utility Model Application Publication No. 53 (1978)-32110).

In the related arts, there occurs a problem that, when the material workpiece is shaped by squeezing by only the friction guides, since the workpiece material is guided while being forcibly shaped, a scratching flaw occurs in a final product. Prevention of such a flaw is is attempted by providing the friction guides to guide the workpiece material with a clearance of several mm between the friction guides and the workpiece material. However, there occurs a problem that biting or engaging performance of the workpiece material to the caliber deteriorates and torsion of the material is easy to occur.

Also, when positions of the friction guides are adjusted, it is possible to adjust the width of the workpiece material in left and right directions. However, as the friction guides cannot be adjusted in a vertical direction, an advancing angle to the rolling roll cannot be adjusted in the vertical direction. Accordingly, there is a problem in which it becomes difficult to effect an exact introducing guide of the material by position adjustment of the friction guides.

Also, the above proposal is for feeding a rough steel material into the grooves of the rolling rolls by using the centering roller and the entrance guide roller. As the feeding of the rough steel material to the grooves of the rolling rolls is directly effected from these rollers positioned at positions spaced from the grooves, there is a limitation in improving an accuracy of the introducing guide for the material. As a result, it becomes difficult to prevent torsion or a flaw from occurring in the rough steel material.

SUMMARY OF THE INVENTION

An object of the present invention is to improve a quality of such a final product as a channel steel material by reducing a possibility that torsion or a flaw occurs in a material to be rolled, hereinafter a workpiece material, guided into grooves of rolling rolls by using an entrance roller guide apparatus.

A feature of the present invention lies in that a combination structure of an entry guide and an upper guide is disposed at an entrance side of an advancing path of a workpiece material, and side rollers, guide rollers and tip end chips are sequentially disposed so that it is made possible to introduce and guide the workpiece material into grooves of rolling rolls without occurrence of torsion or roll flaw.

In this invention, the workpiece material is a shaped steel material which is passed through between the rolling rolls to be formed into a channel steel or an angle steel and which is, in advance, formed into a section preferable as a material to be worked.

Also, the entry guide is disposed at an entrance of the advancing path for the workpiece material and serves as means for effecting a rough position adjustment of the workpiece material, as advancing to the entrance, in a left or right direction. This entry guide is provided with wall faces having a wide entrance width and a narrow exit width at both sides.

Also, the upper guide is provided above and at the same position as the entry guide and acts as a means for effecting a rough position adjustment in a vertical direction on the rough steel material advancing in the upper guide.

Next, the side rollers are provided on a pair of standing shafts downstream of the above entry guide and the upper guide, and they respectively comprise tapered rollers each having a small diameter at an upper portion. The workpiece material passing through between the side rollers is centered while being shaped in left and right directions, and it is fed out to the next guide rollers. It should be noted that the standing shafts axially supporting each side roller are eccentrically mounted shafts which is provided with a fine adjustment means which can be finely adjusted by rotating a worm gear externally.

The guide rollers comprise a pair of rollers which are respectively axially supported on a pair of horizontal shafts at a downstream side of the side rollers so as to be opposed to each other in a vertical direction, and they serve so as to effect a final position adjustment (a leveling adjustment) of the workpiece material in a vertical direction. The workpiece material passes through between the guide rollers so that engagement of the workpiece material with the rolling rolls is made smooth. Thus, the guide rollers serve to prevent misrolling of the workpiece material. It should be noted that the pair of horizontal shafts respectively comprise eccentrically mounted shafts, and they are respectively provided with a fine adjusting means for independently effecting fine adjustment by rotating a gear externally.

The tip end chips are disposed at an exit of the advancing path of the workpiece material, and they serve to adjust introduction of the workpiece material, which has been fed from the guide roller apparatus, into the grooves of the rolling rollers. Particularly, each tip end chip has a function which, when a tip end or the like of the workpiece material could not have been adjusted sufficiently by the side rollers and the guide rollers, leads and guides the workpiece material to prevent left or right shifting or displacement thereof.

DETAILED DESCRIPTION

Figure 1:
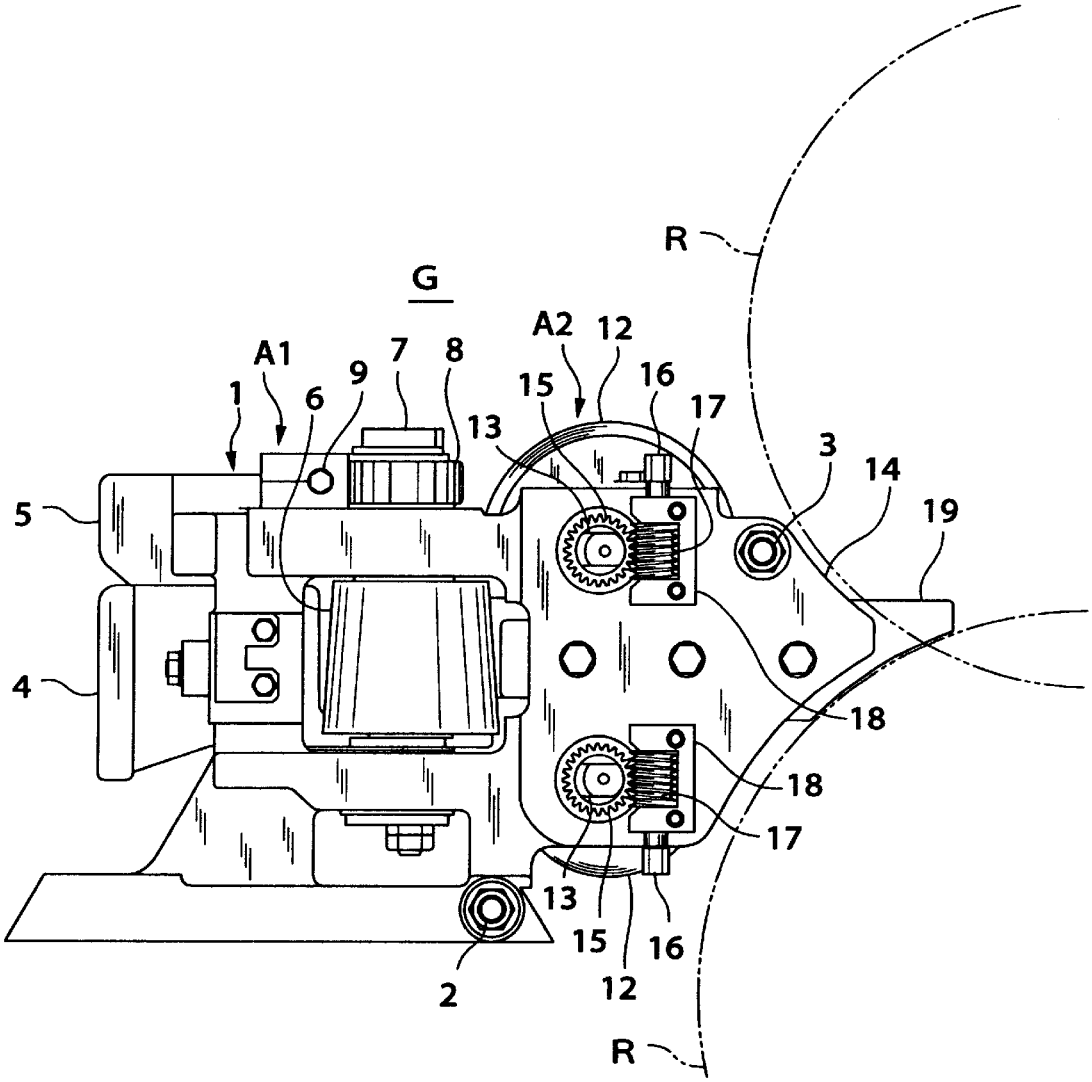
FIG. 1 is a side view of a main portion.
Figure 2:
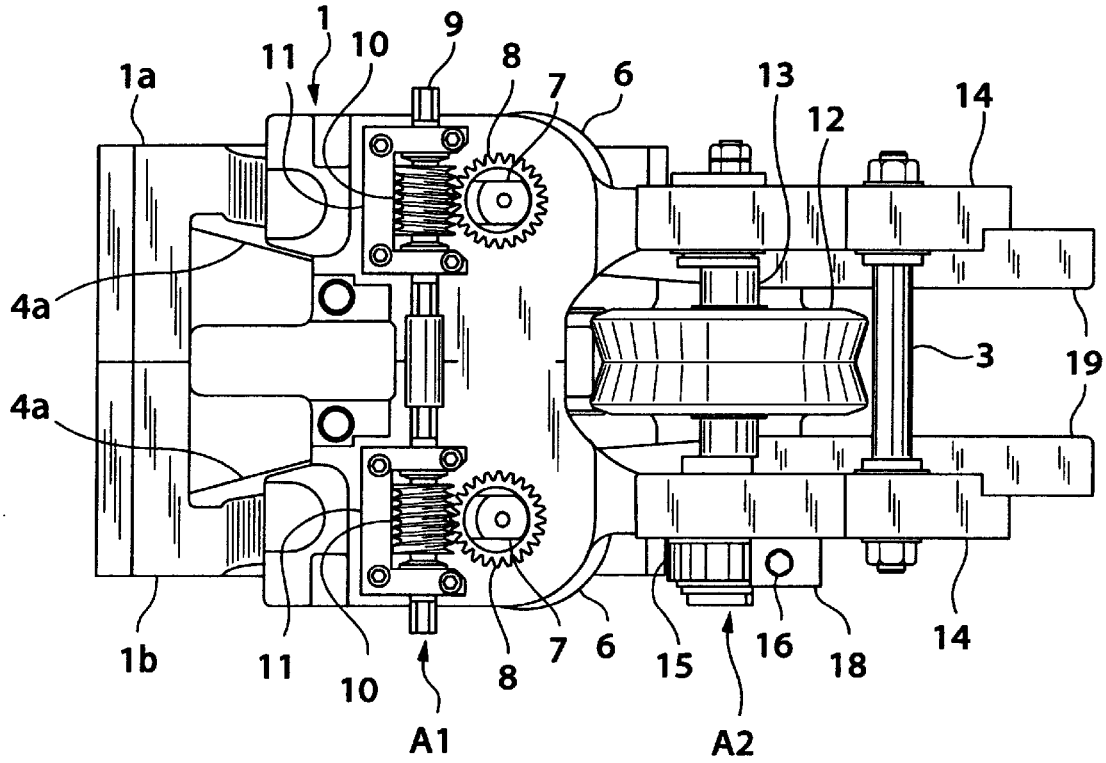
FIG. 2 is a plan view of the main portion.

As shown in FIGS. 1 and 2, an entrance roller guide apparatus G according to the present invention is disposed at a position near an entrance of a pair of upper and lower rolling rolls R, R such that it can lead and guide a material to be rolled.

The entrance roller guide apparatus G has a guide box 1 which is a frame mounted with various guide means described below. The guide box 1 comprises a pair of left and right box members 1*a*, 1*b*. The guide box 1 is assembled by connecting the box members 1*a*, 1*b* with a bolt 2 fixing base portions of the box members 1*a*, 1*b* and a bolt 3 fixing arm portions, described below, and positioned at upper portions thereof.

An advancing path (not shown) by which a material to be rolled passes from left to right in the FIG. 1 is provided in the guide box 1. An entry guide 4 is bolted at an entrance (left end side in FIG. 1) of this advancing path. The entry guide 4 is provided with a bottom plate portion and side plate portions 4*a*, 4*a* formed in a standing manner from both side portions of the bottom plate portion. The respective side plate portions 4*a*, 4*a* are disposed such that their front portions converge toward a central portion between the side plate portions 4*a*, 4*a* in an inclined. Accordingly, these side plate portions 4*a*, 4*a* can roughly adjust the position of the workpiece material, which has advanced along the advancing path, in a left or right direction.

An upper guide 5 is bolted to an upper portion of the entry guide 4. The upper guide 5 guides the workpiece material, which has advanced along the advancing path up to a position just in front of guide rollers described later, while preventing the workpiece material from floating so that it can roughly be position-adjusted in a vertical direction.

Side rollers 6, 6, each comprising a tapered roller formed at its upper portion with a smaller diameter, are disposed at a downstream side of the entry guide 4 and the upper guide 5 in the advancing path of the workpiece material. The respective side rollers 6 are rotatably supported on standing shafts 7, 7 which are eccentrically mounted. The standing shafts 7, 7 are provided with a fine adjustment means A1 for finely adjusting a distance or interval between the side rollers 6, 6 by displacing the standing shafts 7, 7.

The fine adjustment means A1 can perform the position adjustment of the side rollers by rotating gears 8, provided at upper portions of the standing shafts 7 as shaft mounts to shift axial centers of the standing shafts 7. The rotations of the gears 8 can be performed by rotating gear members such as worm gears 10, 10 rotated integrally with a rotation shaft 9 provided horizontally on the guide box 1. It should be noted that the respective worm gears 10, 10 comprise driving gears fixed to the rotation shaft 9 so as to rotate together therewith. The driving gears have threading angles opposed to each other. Accordingly, the respective standing shafts 7, 7 are rotated in directions reverse to each other when the rotation shaft 9 is rotated in one direction, so that they can be displaced so as to approach to or separate from each other.

The rotation shaft 9 is axially supported by bearing members 11, 11 fixed to upper portions of the guide box 1 by bolts. Both end portions of the rotation shaft 9 slightly project from both sides of the guide box 1. This is for allowing rotation of the rotation shaft 9 effected by a handle for fine adjustment.

A pair of upper and lower guide rollers 12, 12 are disposed at downstream side (a right direction in Figures) of the side rollers 6, 6. The respective guide rollers 12 are rotatably supported on horizontal shafts 13, 13 respectively comprising eccentric shafts. Each horizontal shaft 13 is supported horizontally through a pair of mounting plates 14, 14 provided in a projecting manner so as to be opposed to a front portion (a right side portion in Figures) of the guide box 1.

The respective horizontal shafts 13 are provided with a fine adjustment means A2 for finely adjusting a distance between cores of the guide rollers 12, 12 independently. The fine adjustment means A2 is for finely adjusting the respective upper and dower rollers 12, 12 independently, and the basic structure thereof has a mechanism similar to the fine adjustment means A1 of the side roller 6. That is, the fine adjustment means A2 has shaft mounts embodied as driving gears 15, 15 mounted to ends (this side in Figure) of the respective horizontal shafts 13, 13, rotation shafts 16, 16 provided vertically to the mounting plates 14 positioned at this side, and gear members such as worm gears 17, 17 comprising driving gears rotated together with the rotation shafts 16, 16. The respective worm gears 17, 17 are respectively mounted to bearing members 18, 18 so as to be rotated together with the rotation shafts 16, 16.

A pair of tip end chips 19, 19 are provided downward of the guide rollers 12, 12. The tip end chip 19 comprises a plate body formed horizontally at an upper portion while leaving a slight vertical portion at its tip end portion and formed at a lower portion contiguous to the vertical portion in a reverse arc shape approximately corresponding to curvature of an outer periphery of the roll R. The respective tip end chips 19, 19 lead or guide the material to be rolled into grooves of the rolls R, R in cooperation with each other. The respective tip end chips 19, 19 are respectively mounted on inside portions of the mounting plates 14, 14 using bolts.

Next, an operation example is explained in a case where a channel material is rolled.

In a state where the rolling rolls R, R are rotated in directions which allow a workpiece material to be drawn in, the workpiece material is advanced from the entrance (left direction in Figures) of the guide roller apparatus. It should be noted that the workpiece material has preliminarily been formed as a W-shaped rough shape steel of a channel material in a predetermined size in a pre-stage.

The workpiece material, which has advanced along the advancing path in this manner, is roughly position-adjusted in left and right directions by the entry guide 4, and it is roughly position-adjusted in a vertical direction by the upper guide 5.

Furthermore, the workpiece material, which has advanced in the guide roller apparatus, advances to be guided between the side rollers 6, 6 while both sides of the W shaped workpiece material are being shaped in a state where the material is pushed from left and right directions. The workpiece material passes through between the side rollers 6, 6, which are the tapered rollers each having a smaller diameter at its upper portion, to be centered in left and right directions and shaped.

Also, when the workpiece material advances to reach a space between the guide rollers 12, 12, the workpiece material, which has been put in a slightly floating state when it passes through between the side rollers 6, 6, is pressed downwardly by the guide rollers until it is engaged by the upper and lower guide rollers, 12, 12 and it is fed out. The workpiece material is subjected to leveling in a vertical direction by the upper and lower guide rollers 12, 12. After the workpiece material is engaged by the upper and lower guide rollers, it is guided to be fed out by these upper and lower rollers. The workpiece material is guided into the grooves of the rolling rolls effectively without occurrence of a "floating" or a scratching flaw on the workpiece material.

Since both sides of the workpiece material, which has been guided in the above grooves, are shaped by the side rollers 6, 6 so that a width of the workpiece material is made narrower than that of a caliber of the rolling roll and it is restricted so as not to float by the guide roller 12 positioned above, the workpiece material advances in the above grooves without force. It should be noted that, after the workpiece material passes through between the guide rollers 12, 12, it is introduced and guided while being prevented from shifting in a transverse direction by the tip end chips 19. Thereby, it becomes possible to introduce the workpiece material having a width larger than that of the caliber of the rolling roll into the grooves of the rolls without force.

It should be noted that, though the case where a channel material is rolled has been explained in the above embodiment, the present invention is also applicable to rolling manufacturing an angle material.

What is claimed is:

1. An entrance roller guide apparatus for shaping a workpiece and guiding the workpiece into a rolling mill, comprising:

a guide box frame defining a travel path for the workpiece to travel along downstream from an entrance end and to an exit end;

an entry guide extending from said guide box frame at said entrance for horizontally positioning the workpiece at the entrance end of the travel path;

left and right side rollers respectively mounted on left and right vertical shafts downstream of said entry guide for horizontally guiding said workpiece along the travel path, said left and right vertical shafts having ends mounted in said guide box frame to be rigidly positioned with respect to each other to support said left and right side rollers to shape said workpiece by compression and thereby reduce a width of said workpiece; and upper and lower rollers respectively mounted on upper and lower horizontal shafts downstream of said left and right side rollers for vertically leveling said workpiece along the travel path, said upper and lower horizontal shafts being mounted in said guide box frame to be rigidly positioned with respect to each other to support said upper and lower rollers to restrict said workpiece from floating during shaping by said right and left side rollers.

2. The entrance roller guide apparatus according to claim 1, wherein said guide box frame includes a vertical shaft position adjustment mechanism for adjusting a distance between said left and right vertical shafts to position said left and right side rollers to shape said workpiece.

3. The entrance roller guide apparatus according to claim 1, further comprising a vertical guide including an upper guide plates.

4. The entrance roller guide apparatus according to claim 1, wherein said left and right side rollers are tapered from a first end of a first diameter towards a second end of a second diameter smaller than said first diameter to shape said workpiece.

5. The entrance roller guide apparatus according to claim 2, wherein said vertical shaft position adjustment mechanism includes means for simultaneously adjusting said left and right vertical shafts and said left and right side rollers toward said travel path and away from said travel path.

6. The entrance roller guide apparatus according to claim 2, wherein said vertical shaft position adjustment mechanism includes shaft mounts which are rotatably disposed in said guide box frame to rotate about mount axes and said right and left vertical shafts are mounted in said shaft mounts eccentric of said mount axes such that when said shaft mounts are rotated said left and right vertical shafts and said left and right side rollers move toward said travel path and away from said travel path.

7. The entrance roller guide apparatus according to claim 2, wherein said guide box frame includes a horizontal shaft position adjustment mechanism for adjusting a distance between said upper and lower horizontal shafts to position said upper and lower rollers to level said workpiece.

8. The entrance roller guide apparatus according to claim 5, wherein said vertical shaft position adjustment mechanism includes shaft mounts which are rotatably disposed in said guide box frame to rotate about mount axes and said right and left vertical shafts are mounted in said shaft mounts eccentric of said mount axes such that when said shaft mounts are rotated said left and right vertical shafts and said left and right side rollers move toward said travel path and away from said travel path.

9. The entrance roller guide apparatus according to claim 5, wherein said horizontal shaft position adjustment mechanism includes means for simultaneously adjusting said upper and lower horizontal shafts and said upper and lower rollers toward said travel path and away from said travel path.

10. The entrance roller guide apparatus according to claim 8, wherein said means for simultaneously adjusting includes a worm gear member, teeth on said shaft mounts engage said worm gear member, and said worm gear member is threaded to simultaneously rotate said shaft mounts in opposite directions.

11. The entrance roller guide apparatus according to claim 6, wherein said vertical shaft position adjustment mechanism includes gear members, and teeth on said shaft mounts engaging said gear members to permit rotation of said shaft mounts by said gear members.

12. The entrance roller guide apparatus according to claim 11, wherein said gear members are worm gears mounted on a common shaft and threaded to simultaneously rotate said shaft mounts in opposite directions.

13. The entrance roller guide apparatus according to claim 3, wherein said entry guide includes left and right guide plates disposed at said entrance end and converging toward one another in the downstream direction to guide said workpiece between said right and left side rollers.

14. The entrance roller guide apparatus according to claim 13, wherein said left and right side rollers are tapered from a first end of a first diameter towards a second end of a second diameter smaller than said first diameter to shape said workpiece.

15. The entrance roller guide apparatus according to claim 14, wherein said left and right side rollers are frusto-conical.

16. The entrance roller guide apparatus according to claim 15, wherein said first end is a bottom end and said second end is a top end.

17. The entrance roller guide apparatus according to claim 4, wherein said left and right side rollers are frusto-conical.

18. The entrance roller guide apparatus according to claim 17, wherein said first end is a bottom end and said second end is a top end.

19. An entrance roller guide apparatus for shaping a workpiece and guiding the workpiece into a rolling mill, comprising:

a guide box frame defining a travel path for the workpiece to travel along downstream from an entrance end and to an exit end;

an entry guide extending from said guide box frame at said entrance for horizontally positioning the workpiece at the entrance end of the travel path;

left and right side rollers respectively mounted on left and right vertical shafts downstream of said entry guide for horizontally guiding said workpiece along the travel path;

said left and right side rollers being tapered from a first end of a first diameter towards a second end of a second diameter smaller than said first diameter to shape said workpiece;

said left and right vertical shafts having ends mounted in said guide box frame to be rigidly positioned with respect to each other to support said left and right side rollers to shape said workpiece by compression and thereby reduce a width of said workpiece;

said guide box frame including a vertical shaft position adjustment mechanism for adjusting a distance between said left and right vertical shafts to position said left and right side rollers to shape said workpiece; and upper and lower rollers respectively mounted on upper and lower horizontal shafts downstream of said left and right side rollers for vertically leveling said workpiece along the travel path, said upper and lower horizontal shafts being mounted in said guide box frame to be rigidly positioned with respect to each other to support said upper and lower rollers to restrict said workpiece from floating during shaping by said right and left side rollers.

20. The entrance roller guide apparatus according to claim 19, wherein said vertical shaft position adjustment mechanism includes means for simultaneously adjusting said left and right vertical shafts and said left and right side rollers toward said travel path and away from said travel path.

21. The entrance roller guide apparatus according to claim 19, wherein said left and right side rollers are frusto-conical.

22. The entrance roller guide apparatus according to claim 19, further comprising a vertical guide including an upper guide plate.

23. The entrance roller guide apparatus according to claim 20, wherein said vertical shaft position adjustment mechanism includes shaft mounts which are rotatably disposed in said guide box frame to rotate about mount axes and said right and left vertical shafts are mounted in said shaft mounts eccentric of said mount axes such that when said shaft mounts are rotated said left and right vertical shafts and said left and right side rollers move toward said travel path and away from said travel path.

24. The entrance roller guide apparatus according to claim 23, wherein said means for simultaneously adjusting includes a worm gear member, teeth on said shaft mounts engage said worm gear member, and said worm gear member is threaded to simultaneously rotate said shaft mounts in opposite directions.

25. The entrance roller guide apparatus according to claim 24, wherein said left and right side rollers are frusto-conical.

26. The entrance roller guide apparatus according to claim 22, wherein said entry guide includes left and right guide plates disposed at said entrance end and converging toward one another in the downstream direction to guide said workpiece between said right and left side rollers.

27. A method for shaping a workpiece and guiding the workpiece into a rolling mill, comprising:

providing a guide box frame defining a travel path for the workpiece to travel along downstream from an entrance end and to an exit end;

providing an entry guide extending from said guide box frame at said entrance for horizontally positioning the workpiece at the entrance end of the travel path;

providing left and right side rollers respectively mounted on left and right vertical shafts downstream of said entry guide for horizontally guiding said workpiece along the travel path, said left and right vertical shafts having ends mounted in said guide box frame to be rigidly positioned with respect to each other to support said left and right side rollers to shape said workpiece by compression and thereby reduce a width of said workpiece;

providing upper and lower rollers respectively mounted on upper and lower horizontal shafts downstream of said left and right side rollers for vertically leveling said workpiece along the travel path, said upper and lower horizontal shafts being mounted in said guide box frame to be rigidly positioned with respect to each other to support said upper and lower rollers to restrict said workpiece from floating during shaping by said right and left side rollers;

positioning said guide box frame at an entrance of the rolling mill; and feeding said workpiece along said travel path to effect shaping of said workpiece by said left and right side rollers while being guided by said entry guide and leveled by said upper and lower rollers and to effect subsequent rolling by said rolling mill.

28. The method according to claim 27, wherein said guide box frame includes a vertical shaft position adjustment mechanism for adjusting a distance between said left and right vertical shafts to position said left and right side rollers to shape said workpiece.

29. The method according to claim 27, wherein said left and right side rollers are tapered from a first end of a first diameter towards a second end of a second diameter smaller than said first diameter to shape said workpiece.

30. The method according to claim 28, wherein said vertical shaft position adjustment mechanism includes means for simultaneously adjusting said left and right vertical shafts and said left and right side rollers toward said travel path and away from said travel path.

31. The method according to claim 30, wherein said vertical shaft position adjustment mechanism includes shaft mounts which are rotatably disposed in said guide box frame to rotate about mount axes and said right and left vertical shafts are mounted in said shaft mounts eccentric of said mount axes such that when said shaft mounts are rotated said left and right vertical shafts and said left and right side rollers move toward said travel path and away from said travel path.

32. The method according to claim 31, wherein said means for simultaneously adjusting includes a worm gear member, teeth on said shaft mounts engage said worm gear member, and said worm gear member is threaded to simultaneously rotate said shaft mounts in opposite directions.

33. The method according to claim 29, wherein said left and right side rollers are frusto-conical.

34. The method according to claim 33, wherein said first end is a bottom end and said second end is a top end.

* * * * *